United States Patent [19]

Allison et al.

[11] 4,068,567

[45] Jan. 17, 1978

[54] COMBINED EJECTOR-GATE MEANS FOR ROTATABLE TABLE OF AN ARTICLE COUNTER-STACKER

[75] Inventors: Arthur F. Allison, Aurora; Dennis C. Christopherson, Denver; Byron L. Mays, Boulder; Reginald A. Reed, Golden, all of Colo.

[73] Assignee: Cutler-Hammer, Inc., Milwaukee, Wis.

[21] Appl. No.: 764,081

[22] Filed: Jan. 31, 1977

[51] Int. Cl.[2] ..... B31B 1/98; B65G 57/09

[52] U.S. Cl. ..... 93/93 C; 93/93 DP; 214/6.5

[58] Field of Search ..... 93/93 C, 93 DP, 93 R; 214/6.5, 6 D, 6 DK; 198/422

[56] References Cited

U.S. PATENT DOCUMENTS

| | | | |
|---|---|---|---|
| 3,532,230 | 10/1970 | Gutberlet et al. | 93/93 DP UX |
| 3,568,578 | 3/1971 | Fujishiro | 214/6.5 X |
| 3,568,815 | 3/1971 | Wiseman | 93/93 DP X |
| 3,599,807 | 8/1971 | Hedrick et al. | 214/6.5 |

*Primary Examiner*—James F. Coan

*Attorney, Agent, or Firm*—H. R. Rather; Wm. A. Autio; M. E. Taken

[57] ABSTRACT

An oscillating stack receiving table carries thereon a pair of cooperating chain driven ejector assemblies which function in their "at rest" position as gates to stabilize the stack of articles during rotation of the table and which are operable to sweep across the table when the latter is "at rest" to eject the stack of articles from the table onto associated take-away conveyor apparatus.

13 Claims, 5 Drawing Figures

COMBINED EJECTOR-GATE MEANS FOR ROTATABLE TABLE OF AN ARTICLE COUNTER-STACKER

BACKGROUND OF THE INVENTION

This invention relates to machines for counting and stacking flexible articles and more particularly to such machines for counting and stacking newspapers being delivered from a printing and assembling operation in an overlapped conveyor stream. The ever increasing speeds of newspaper printing presses have placed demanding requirements upon the efficiency, reliability and operating speeds of the associated newspaper handling apparatus, particularly that apparatus employed in the mailroom sections of printing plants where the individual papers are stacked, bundled and dispatched to waiting trucks for ultimate delivery to the subscriber.

The wedge shape of newspapers due to their folded edge limits the number of papers that may be contained in a stable, free-standing stack. To provide stacks of greater numbers of papers it is necessary to compensate for the wedge shape by forming stacks of two or more batches wherein the folded edges of each batch are displaced 180°. To accomplish this, the counter-stacker machine must rotate its stack receiving table 180° between batch deliveries thereto. The operating time for such rotation is dependent upon the batch delivery time which in turn is dependent upon stacking time for the predetermined number of papers which is ultimately dictated by the press speed and rate at which papers are delivered therefrom. In addition to rotating the table between batch deliveries, the counter-stacker machine must also be capable of dispatching its stack in an equal period of time to permit the next batch to be delivered.

At modern press speeds, the rotating and ejecting speeds of the counter-stacker serve to provide unsettling forces upon the stack, thereby requiring particular attention to the support of the stack during such operations. The tables have been provided with front and rear vertical guide plates, and movable gates have been provided at the ends of such plates for restraining the ends of the stack during rotation. The ejector means customarily are chain driven bars which sweep across the table to eject the stack. Such ejector bars must be positioned out of the rotational path of the table during indexing thereof, and therefor must travel a certain distance before engaging the stack when they are operated. Moreover, operation of the gates and ejector mechanisms must be positively correlated to prevent damage to the machine. Each of the foregoing serve to reduce operating cycle time and efficiency of the machine.

SUMMARY OF THE INVENTION

It is a primary object of this invention to provide a counter-stacker machine for flexible articles such as newspapers or the like which is capable of forming compensated stacks of such articles and has improved support means for the stack during operation of the machine.

It is a further object of this invention to provide a machine of the aforementioned type having lower stack ejection speeds and therefor less unsettling forces applied to the stack.

It is a more specific object of this invention to provide a machine of the aforementioned type wherein the functions of table gates and stack ejectors are combined in a single mechanism.

It is still another object of this invention to provide a machine of the aforementioned type which offers advantages in manufacturing costs, operation and reliability.

These and other objects and advantages will become more apparent in the following specification and claims when read in conjunction with the accompanying drawings.

DESCRIPTION OF THE PREFERRED EMBODIMENT

Figure 1:
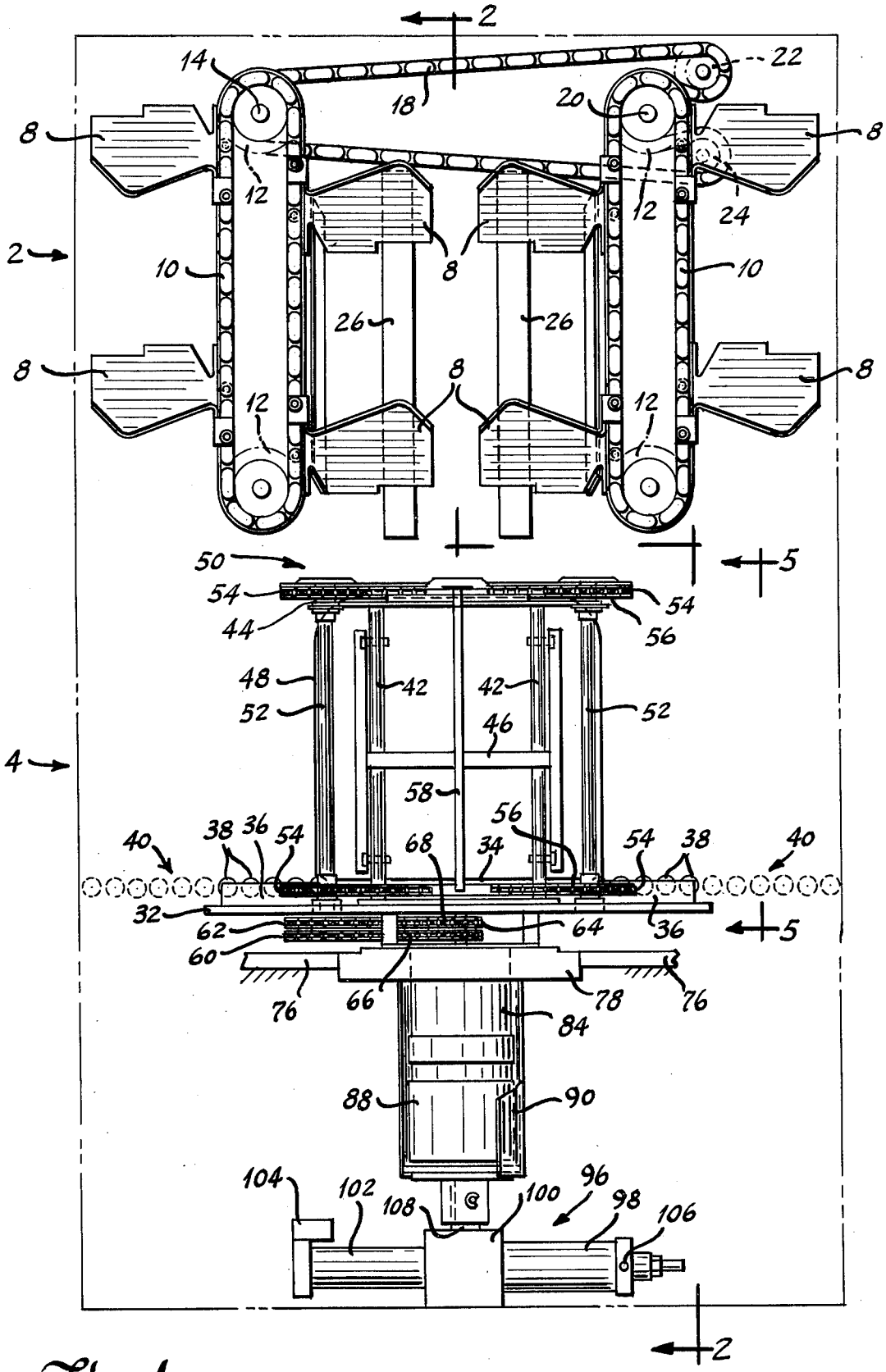
FIG. 1 is a schematic elevational view of the input side of the counter-stacker machine of this invention with the framework and sheet metal enclosure omitted for clarity.
Figure 2:
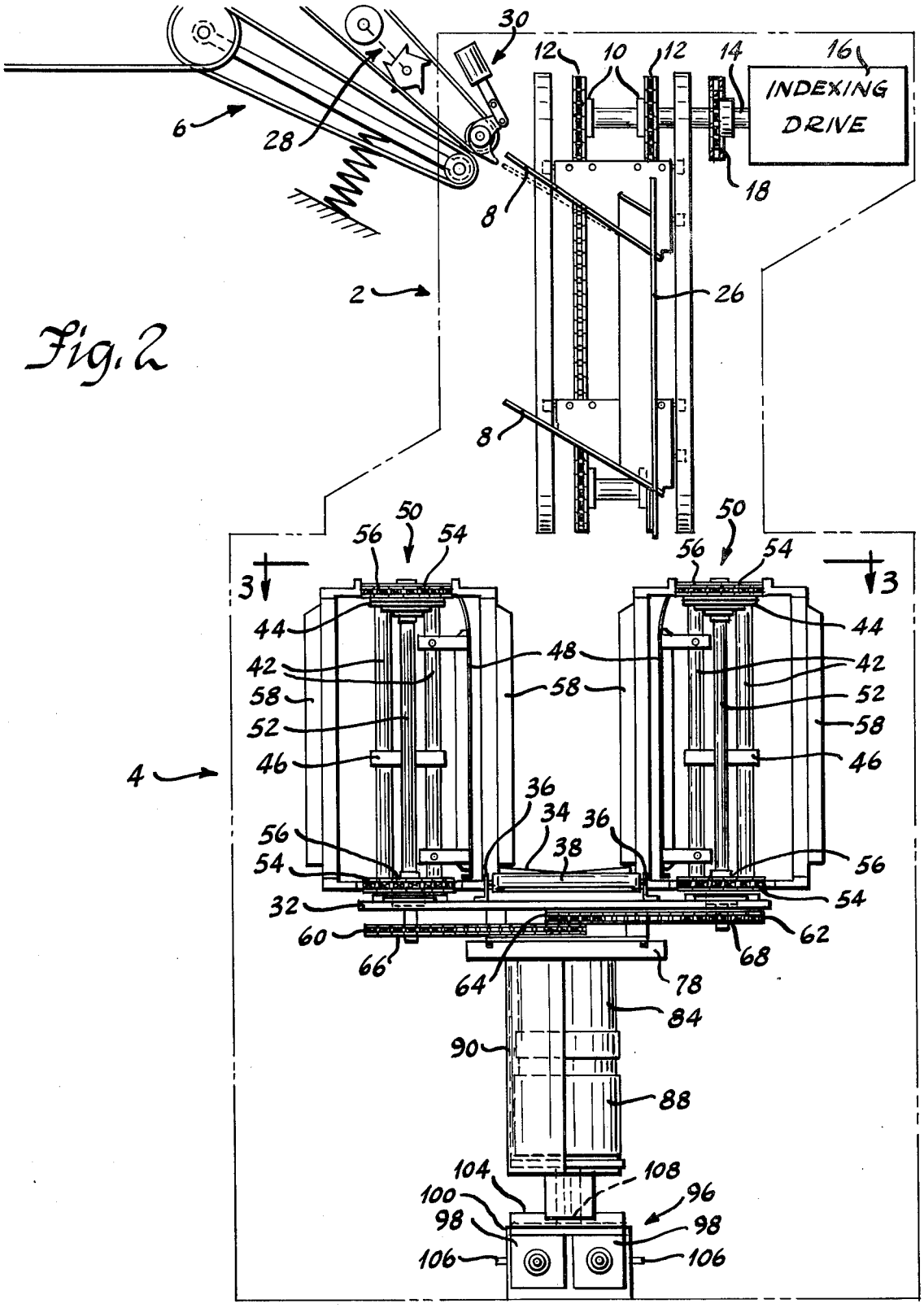
FIG. 2 is a side view taken along the line 2—2 of FIG. 1.

With particular reference to FIGS. 1 and 2 of the drawings, the counter-stacker machine of this invention may be seen to comprise an upper unit, or stacking section, 2 and a lower unit, or table section, 4. The upper unit 2 receives newspapers in a lapped stream from a downwardly directed input conveyor 6. The papers stack one upon another on cooperating pairs of upward angled blades 8 which are carried on pairs of coextensive endless chains 10 trained around pairs of vertically aligned upper and lower sprockets 12. The lower sprockets 12 are secured to idler shafts. One of the upper sprockets is secured to a drive shaft 14 connected to a controlled acceleration indexing cam drive means 16. A link chain 18 is trained around additional sprockets on the shaft 14 and on the other upper shaft 20, and around idler reversing sprockets 22 and 24 to provide reverse power to the opposite set of chains 10. Through the aforedescribed mechanism the cooperating pairs of blades 8 are indexed downwardly in unison along the inner reaches of chains 10. A pair of vertical guides 26 are mounted in the rear of the stacking section adjacent the rear edges of blades 8 to provide a stopping surface for the leading edges of the papers as they are received from input conveyor 6.

A counting mechanism 28 is provided in the input conveyor 6, the mechanism 28 being engaged by the leading edge of each paper to register an accumulative count. A solenoid operated latch assembly 30 is also provided on the input conveyor 6 at the exit end thereof. The latch assembly normally extends into the path of the pair of blades 8 which are next above the blades 8 upon which papers are stacking. The blades 8 are pivotally supported upon the chains 10 and spring biased to the normal position, but the engagement by the latch mechanism 30 with the aforementioned pair of blades at the exit end of the input conveyor displaces these blades slightly upwardly against the bias of the spring.

Indexing drive means 16, latch assembly 30 and counting mechanism 28 are brought together through a suitable electrical control system such that latch assembly 30 releases the particular blades 8 and indexing drive means 16 indexes those blades to the lower stacking position in response to a signal from the counting mechanism 28 indicating the passage of a predetermined number of papers. Such indexing movement also drives the lower cooperating blades 8 around the lower sprockets 12 to cause these blades to move rapidly apart and out of their supporting position beneath the stacked batch of papers formed thereon. As a result of this movement the batch of papers is deposited free-fall onto the table of the lower unit. A further understanding of the stacking section 2 may be had by referring to U.S. Pat. No. 3,532,230 issued Oct. 6, 1970 to the assignee of this application.

Figure 3:
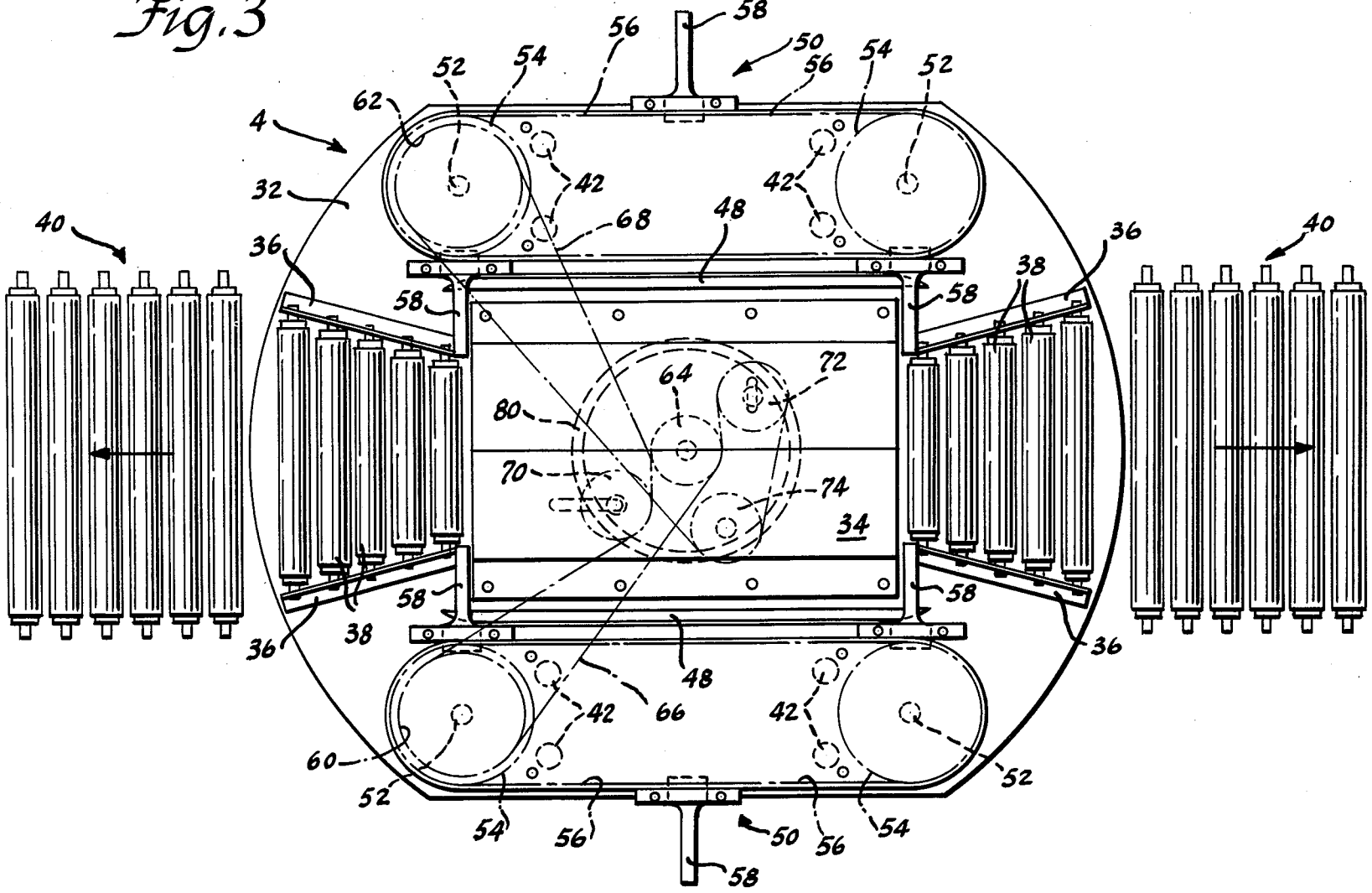
FIG. 3 is a plan view of the lower unit of the counter-stacker machine taken along the line 3—3 of FIG. 2.
Figure 4:
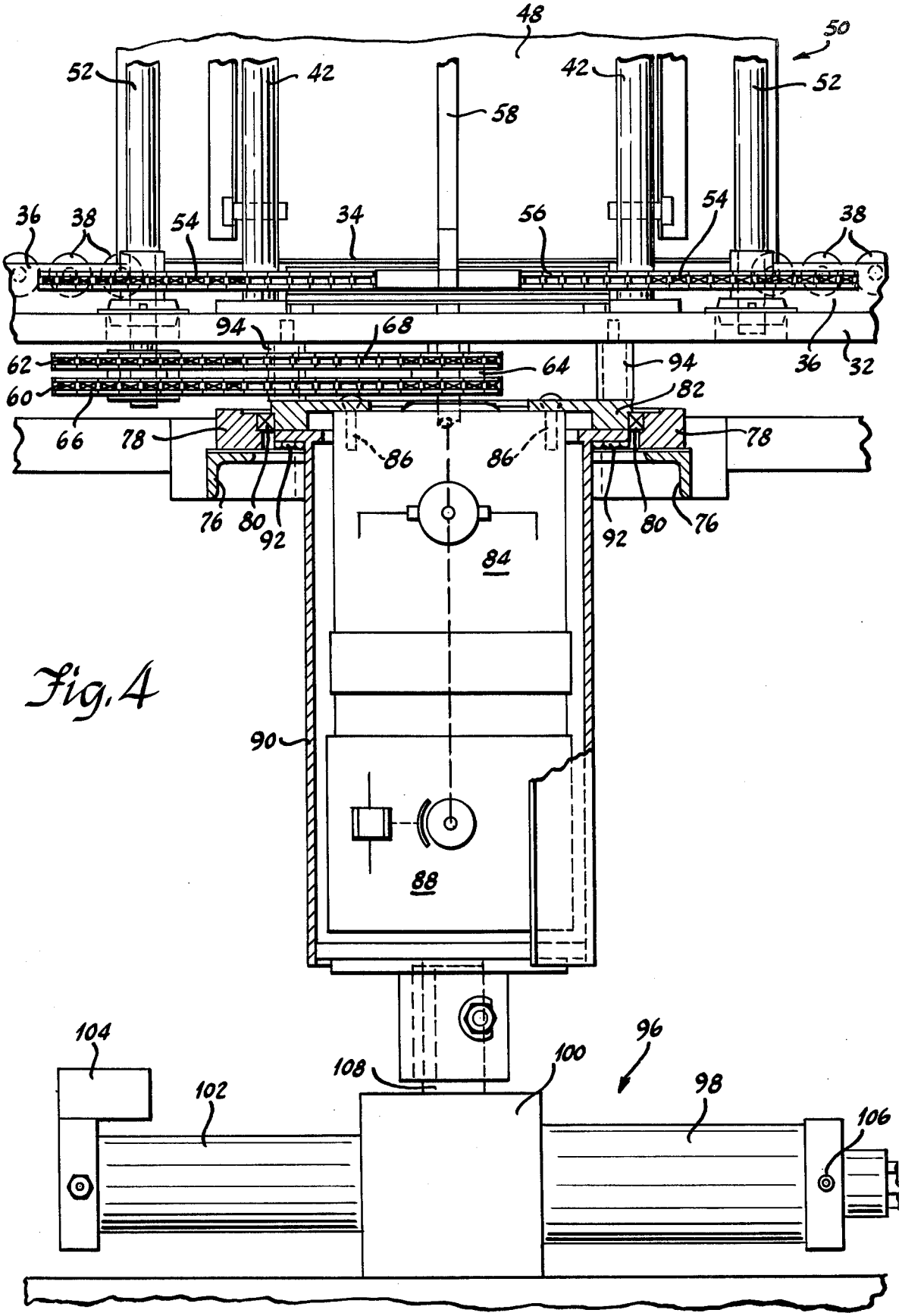
FIG. 4 is a view of a portion of the lower unit as shown in FIG. 1, but drawn to a greater scale and having portions broken away.
Figure 5:
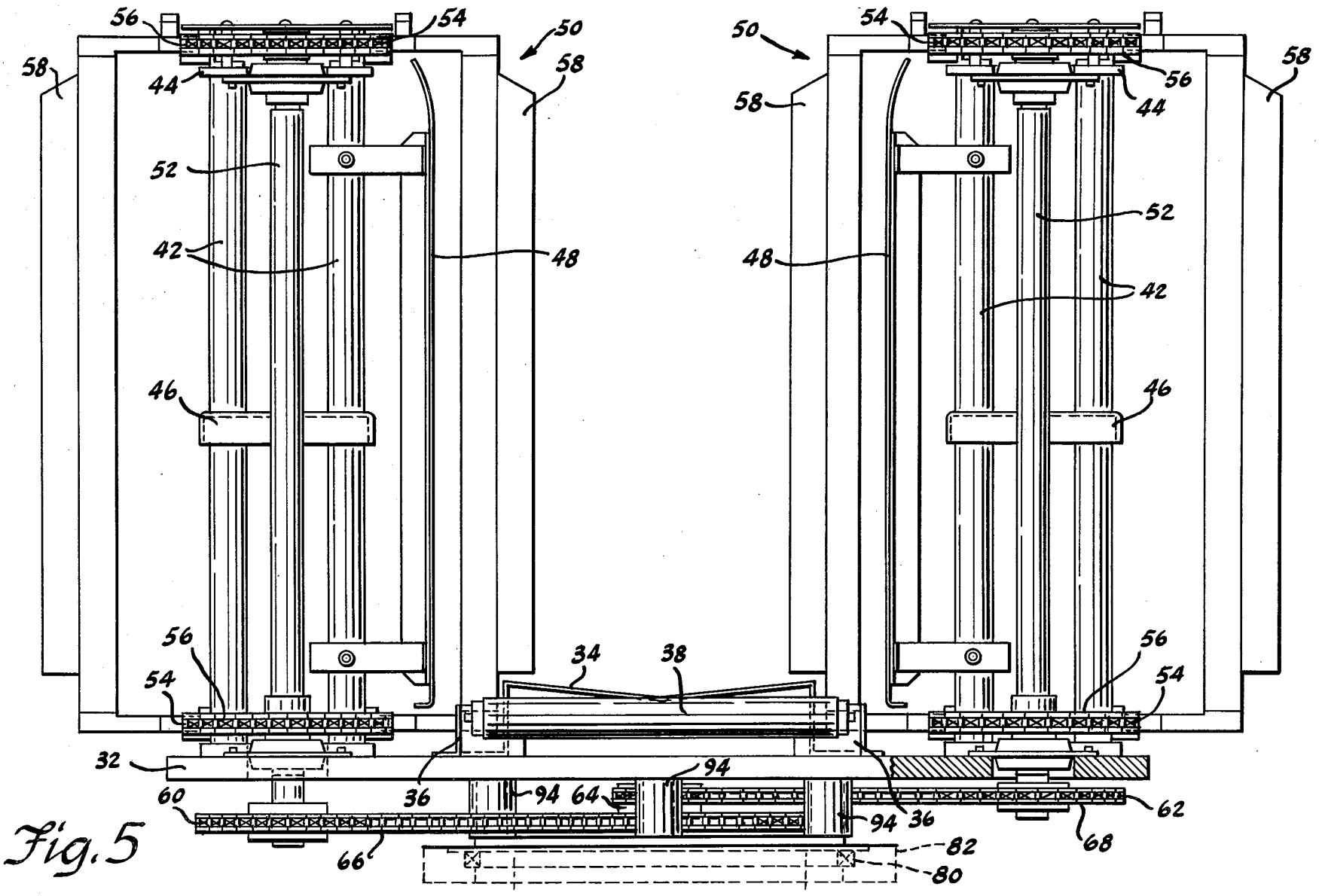
FIG. 5 is a view partly in section taken along the line 5—5 of FIG. 1.

The lower unit 4 of the counter-stacker machine is shown in greater detail in FIGS. 3, 4 and 5. The stack receiving portion comprises a flat table 32 having a stack supporting plate 34 centrally mounted on the upper side thereof. Pairs of angle brackets 36 are mounted to the top surface of table 32 adjacent each end of supporting plate 34, the brackets 36 being positioned in an outwardly diverging manner. A plurality of freely rotatable rollers 38 are mounted between the respective pairs of brackets 36 to serve as conveyor extensions connecting the supporting plate 34 with short conveyor segments 40. The latter consist of a plurality of idler rollers mounted on the framework of the machine. In use, powered take-away conveyors are connected to the machine adjacent the segments 40.

A pair of upstanding support structures are mounted on the upper side of table 32 on the front and back sides of the supporting plate 34. Each support structure comprises four vertical bars 42, a top plate 44 and an intermediate plate 46. Attached to the inner-most pairs of bars 42 are side guide plates 48 which extend vertically on each side of support plate 34 to provide vertical alignment and support for the folded and cut edges of the stack of newspapers.

A pair of combination gate and ejector mechanisms 50 are mounted in the above described upstanding support structures. The gate and ejector mechanisms comprise vertically extending shafts 52 journalled in bearing blocks attached to the upper surface of table 32 and to the top plates 44. Each shaft 52 has secured thereto upper and lower sprockets 54, which have respective upper and lower link chains 56 trained therearound. Each respective upper and lower chain pair has secured thereto preferrably three ejector bar assemblies 58 at equally spaced intervals on the chains to extend vertically therebetween. The bars 58 project outwardly at right angles to the chains to extend inwardly over the plate 34 on the inner reaches of the respective chains. The interval spacing of the bars 58 is selected such that two of the three bars are positioned at opposite ends of the support plate 34 to serve as vertical guides for the ends of the papers as they are dropped onto the plate 34. The corresponding bars 58 from each gate and ejector assembly 50 are transversely aligned in this position and cooperate with the side guides 48 to box-in the stack receiving area of the lower unit. A lesser or greater number of bars 58 may be employed for each mechanism 50, but it is important that at least one bar be in guiding position at an end of the stack.

As viewed in FIGS. 1, 3 and 4, the left-hand shafts 52 project through the table 32 to the underside thereof. The forward-most shaft 52 receives a drive sprocket 60 thereon at its lower end while the rear-most shaft 52 receives a drive sprocket 62 thereon. Sprockets 60 and 62 cooperate with a centrally located double sprocket 64 which is fixed to the output shaft of a drive motor as will be more fully described hereinafter. Chains 66 and 68 connect sprockets 60 and 62, respectively, with double sprocket 64. As shown in dot-dash lines in FIG. 3, chain 66 also extends around an idler sprocket 70, the position of which is adjustable to achieve proper tension for the chain. The chain 68 extends around a similar adjustable sprocket 72 and a second reversing sprocket 74 to reverse the direction of the power supplied to rear assembly 50 with respect to the front assembly 50. The pulleys 70, 72 and 74 are rotatably mounted on the underside of table 32.

The supporting structure for the table 32 and attached mechanism will now be described with particular reference to FIG. 4. A segment of the counter-stacker machine framework 76 is shown to which is attached a seat 78 for a ring bearing 80. Supported from the inner race of ring bearing 80 is a mounting plate 82 for a reversible electric motor 84 which is secured thereto by screws 86. The drive shaft of motor 84 extends upwardly through a central aperture in mounting plate 82 for attachment to double sprocket 64 as hereinbefore described, the motor preferrably being mounted such that the output shaft extends coaxially with the axis of rotation for the table 32. An electromagnetic brake 88 is attached to the housing of motor 84 at the lower end, the brake being operably connected to the shaft of motor 84.

A shell 90, concentric to the axis of table rotation and to the motor 84 and brake 88, is secured to the underside of mounting plate 82 by bolts 92 which extend through shell 90, mounting plate 82 and cylindrical spacer sleeves 94 to take into threaded openings in the underside of table 32. Accordingly the entire table assembly, motor 84, brake 88 and shell 90 are rigidly secured together and rotatably supported upon the counter-stacker frame by the ring bearing 80.

Shell 90 is connected at its lower end to the output shaft of rotary actuator mechanism 96. This mechanism is a commercially available pneumatic hydraulic actuator and is shown only generally in the drawings. The mechanism comprises a pair of parallel air cylinders 98 mounted on one side of a gear housing 100 and a pair of parallel hydraulic cylinders 102 mounted on the opposite side of housing 100 in respective alignment with the air cylinders. The internal pistons or plungers of the corresponding aligned air cylinders and hydraulic cylinders are internally connected by rack gear segments which mesh with a pinion gear disposed between the racks within the housing 100. The hydraulic cylinders 102 are interconnected by means of a restricting valve structure 104 wherein the fluid exhausted by one cylinder 102 is fed into the other cylinder 102 at a predetermined rate. The interconnected hydraulic cylinders operate to control the speed of the actuator and as a cushion therefor. The two air cylinders 98 have single ports 106 for connection to a suitable air supply through a solenoid operated reversing valve (not shown) which alternately directs air into one cylinder 98 and exhausts the other cylinder 98. In operation, air fed into one cylinder 98 extends the piston of that cylinder toward the gear housing 100 and exhausts the fluid from the corresponding hydraulic cylinder 102, driving the interposed rack past the pinion gear to rotate air output shaft 108 in a first rotary direction. A subsequent operation will direct air to the other cylinder 98 causing the reverse movement of the various parts and cause reverse rotation of the shaft 108. As mentioned above, the output shaft 108 of rotary actuator mechanism 96 is fixedly attached to the lower end of shell 90.

In operation, the aforementioned reversing valve for air cylinders 98 is suitably connected into the control system for the counter-stacker to be operated in response to the completion of an indexing operation of the stacking blades 8. Thus, as a batch of newspapers is dropped onto the plate 34 and the blade indexing movement is complete such that the blades have passed through and free of the upstanding table superstructure, the reversing valve is operated to reverse the air supply to the rotary actuator mechanism 96. Accordingly, the output shaft 108 is operated through a 180° revolution to rotate the table 32, attached superstructure and the batch of papers deposited thereon 180°.

Inasmuch as the motor 84 and brake 88 are also attached to the table 32, these items rotate with the table. Accordingly, the ejector assemblies 50 have no movement relative to the table during table rotation, and the ejector bars 58 positioned at the four corners of the batch of papers serve as gates to prevent inertial forces from upsetting the batch of papers during rotation.

The control system may be set to cause table rotation after alternate batch deliveries, or after successive second and third deliveries, depending upon the number of batches desired per stack. Completion of the particular indexing operation of stacking blades 8 which deposits the final batch onto the stack effects no control signal to the reversing valve for the rotary actuator mechanism 96 but instead sends a signal to a circuit which energizes the motor 84 and releases brake 88. The motor 84 is reversible and may be energized for rotation in either direction, again according to a setting of the control system. Operation of motor 84 drives the ejector mechanisms 50 in unison through one indexing movement to cause the bars 58 at one end of the table to cooperatively move across the table to the other end thereof, thereby sweeping the stack from the plate 34 to and beyond one or the other of the conveyor segments 40 and the associated take-away conveyor. The duration of energization of motor 84 and hence the amount of travel for one indexing movement of the ejector mechanisms 50 may be suitably controlled by limit switches operating in response to positions of the ejector bars 58 or cams placed on the chains 56 in a well known manner. The amount of movement is such that the bar 58 at one end of the table will move to assume the position of the similar bar the other end of the table, wherein the third bar 58 formerly occupying the position on the outer reach of the chains 56 will be brought around to take the former position of the first mentioned bar 58. Inasmuch as the gate/ejector mechanism is mounted to the table for rotation therewith, and the bars 58 may therefor be in the gate position engaging the ends of the stack, no pretravel of the ejector bars is required to bring the bars to the stack and thus the cycle time for the ejector travel is reduced. The benefit of this is used to the best advantage by maintaining the cycle time the same as in prior art devices, but reducing the speed of the ejector travel to apply reduced inertial forces to the stack during ejection.

While the apparatus hereinbefore described is effectively adapted to fulfill the objects stated, it is to be understood that the invention is not intended to be confined to the particular preferred embodiment of counter-stacker machine disclosed, inasmuch as it is susceptible of various modifications without departing from the scope of the appended claims.

We claim:

1. In an apparatus for conveying, counting and stacking articles having an input conveyor for delivering articles in a lapped stream, counting means for counting articles passing a point in said input conveyor, stacking means at the output end of said conveyor for stacking said articles one upon another and a table for receiving said stack of articles from said stacking means, the combination comprising:

vertical guide means mounted on said table for engaging opposite edges of said articles in said stack;

ejector means mounted on said table and positioned for engagement with the ends of said articles in said stack at at least one unguided end of said stack;

means operable to drive said ejector means across said table to eject said stack of articles therefrom; and means operable to rotate said table, said guide means and said ejector means through one-half revolution and to restrain said ejector means against movement relative to said table during rotation thereof, whereby said guide means and said ejector means cooperate to provide vertical support to said stack during table rotation.

2. The apparatus as defined in claim 1, wherein said ejector means comprises at least one vertical member extending over the height of said stack of articles, said member being attached to a closed loop endless chain mechanism rotatably supported on said table, motive power for said mechanism being provided by a drive member mounted coaxially with the axis of table rotation.

3. The apparatus as defined in claim 2 wherein said drive member is inoperative during operations of the apparatus in which said table is rotated, said drive member rotating in fixed relation to said table, and wherein said drive member is operative to rotate independently of said table during operations of the apparatus in which said table remains stationary.

4. The apparatus as defined in claim 3 wherein operation of said ejector mechanism is in a direction such that said vertical member moves across said table from said guiding position in engagement with one end of said stack toward the opposite end of said stack.

5. The apparatus as defined in claim 1 wherein said ejector means comprises a plurality of vertical members extending over the height of said stack of articles, said members being attached to a closed loop endless chain mechanism rotatably supported on said table, said vertical members being positioned at each end of said stack of articles for guiding engagement with the ends of said articles in said stack.

6. The apparatus as defined in claim 5 wherein motive power is provided said mechanism by a drive member mounted coaxially with the axis of table rotation and said drive means is operable in either rotational direction to drive said vertical members across said table in either longitudinal direction.

7. In an apparatus for conveying, counting and stacking articles, said apparatus comprising an input conveyor for delivering articles in a lapped stream, counting means for counting said articles passing a point in said input conveyor, stacking means at the output end of said conveyor for receiving said articles one upon another, indexing means for said stacking means for intercepting said stream at a predetermined article as determined by said counting means to cause following articles to stack upon a succeeding station of said stacking means and to deposit the stack of articles formed on the original stacking station upon a stack receiving table, the combination comprising:

vertical guide means mounted on said table engaging the opposite edges of said articles in a stack deposited on said table;

means mounting said table for rotation about a vertical axis through the center of said stack receiving portion;

first drive means operable upon completion of a selected indexing operation of said stacking means to rotate said table through one-half revolution;

ejector means mounted on said table, said ejector means comprising a pair of endless chain mechanisms mounted on opposite sides of said table and each having at least one vertical bar member thereon positioned at an end of the stack receiving portion of said table for guiding engagement with the ends of said articles in a stack deposited on said table; and second drive means operable upon another selected indexing operation of said stacking means to move said vertical bar members in unison longitudinally across said table to eject said stack of articles therefrom, said second drive means being inoperative during operation of said first drive means to maintain said vertical bar members fixed with respect to said table, thereby to cooperate with said vertical guide means to provide vertical support to said stack of articles during table rotation.

8. The combination according to claim 7 wherein said ejector means includes at least two vertical bar members on each endless chain mechanisms, said vertical bar members being positioned at each end of the stack receiving portion of said table for guiding engagement with the ends of said articles at each end of a stack deposited on said table.

9. The combination according to claim 8 wherein said second drive means is selectively operable to move said vertical bar members in unison longitudinally across said table in either direction.

10. The combination according to claim 9 wherein said second drive means comprises a reversible motor mounted to the underside of said table and having its output shaft aligned coaxially with the axis of table rotation.

11. The combination according to claim 7 wherein said first drive means is successively operable upon completion of a predetermined succession of indexing operation, and is inoperative upon completion of a selected indexing operation following said succession, whereupon said second drive means is operable upon completion of said selected indexing operation following said succession.

12. The combination according to claim 11 wherein said first drive means is connected to said table by a frame member attached to the underside of said table and concentric about the rotational axis of said table.

13. The combination according to claim 12 wherein said first drive means is alternately operable in reverse rotational directions to provide oscillating movement for said table.

* * * * *